US010596405B2

(12) United States Patent
Waldner et al.

(10) Patent No.: US 10,596,405 B2
(45) **Date of Patent: *Mar. 24, 2020**

(54) DEVICE FOR CONTROLLING THE TRAINING AND THE THERAPEUTIC TREATMENT AND/OR FOR SUPPORTING THE LOWER EXTREMITIES OF A HUMAN

(71) Applicant: Villa Melitta GmbH, Bozen (IT)

(72) Inventors: Rupert Waldner, Bozen (IT); Julius Michael Waldner, Bozen (IT); Christopher Tomelleri, Bozen (IT)

(73) Assignee: Reha Technology AG, Olten (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/139,883

(22) Filed: Sep. 24, 2018

(65) Prior Publication Data

US 2019/0022449 A1 Jan. 24, 2019

Related U.S. Application Data

(63) Continuation of application No. 15/005,418, filed on Jan. 25, 2016, now Pat. No. 10,080,915.

(30) Foreign Application Priority Data

Jan. 28, 2015 (EP) ..... 15000260

(51) Int. Cl.
*A61H 1/02* (2006.01)
*A63B 21/02* (2006.01)
(Continued)

(52) U.S. Cl.
CPC ..... *A63B 21/023* (2013.01); *A61H 1/0262* (2013.01); *A63B 21/00178* (2013.01);
(Continued)

(58) Field of Classification Search
CPC ..... A63B 22/20; A63B 22/201; A63B 22/203; A63B 22/04; A63B 22/0664; A63B 22/0688; A63B 21/023; A63B 21/4034; A63B 21/00181; A63B 22/0058; A63B 69/0028; A63B 21/00178; A63B 2213/00;
(Continued)

(56) References Cited

U.S. PATENT DOCUMENTS 3,316,898 A 5/1967 Brown
3,421,760 A 1/1969 Freeman
(Continued)

*Primary Examiner* — Joshua Lee
(74) *Attorney, Agent, or Firm* — Brinks Gilson & Lione

(57) ABSTRACT

A device for the therapeutic treatment and/or training of the lower extremities of a human having driven and controlled movement devices, which are connected to a stationary frame and include holding members for fastening of one extremity. The holding members can be moved independently of one another along walking trajectories. The movement devices each include a pivot arm pivotable into different elevations, and the pivot arm is rotatably connected to one single sled on a linear track. A first rotational drive is attached to a single sled and is connected to the pivot arm for changing the elevation of the respective holding member. The pivot arm includes a second rotational drive for changing the inclination of the respective holding member and the sled is connected to a linear drive for changing the longitudinal position of the respective holding member.

20 Claims, 5 Drawing Sheets

Figure 1:
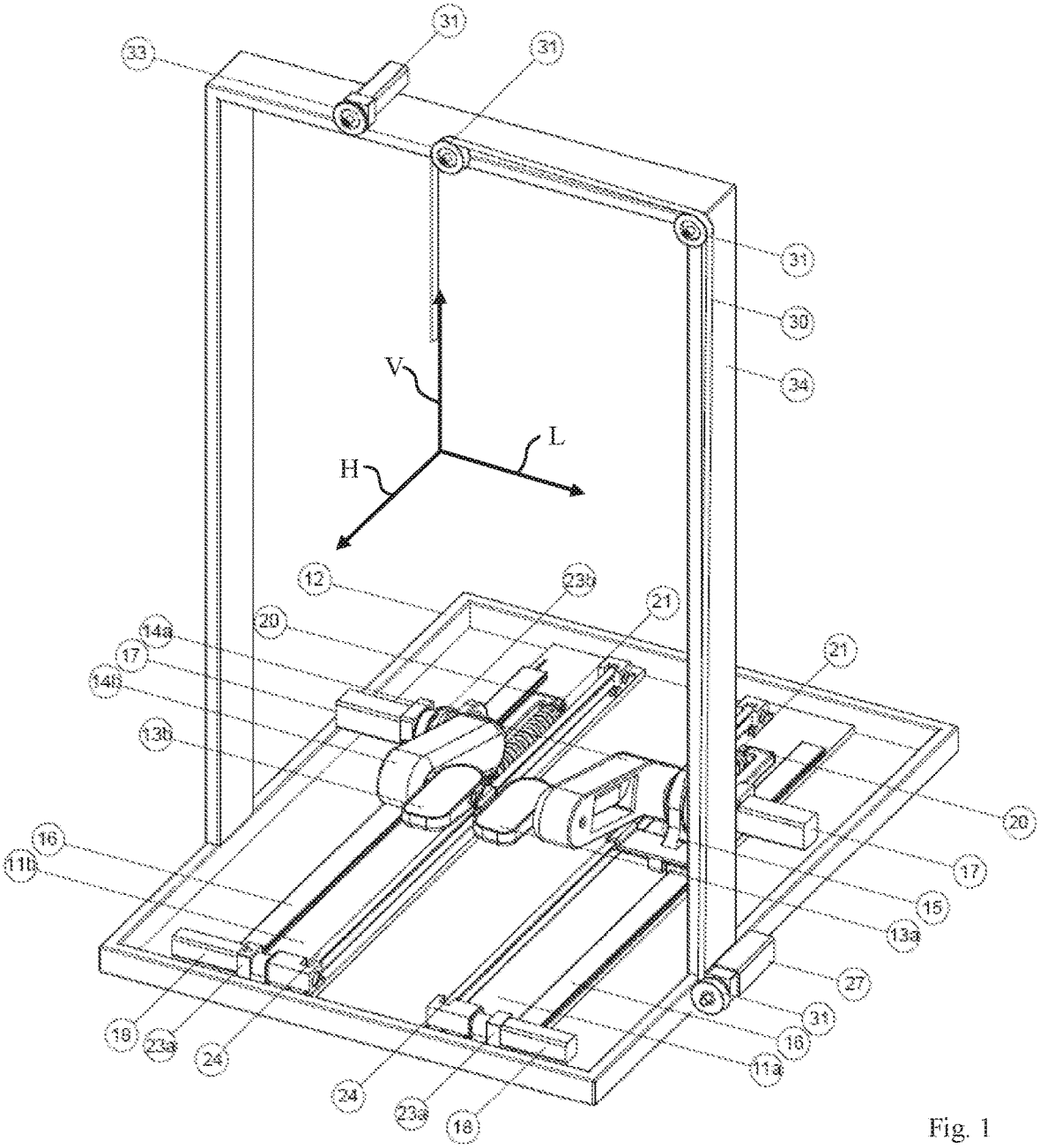

(51) Int. Cl.

| | |
|---|---|
| ***A63B 21/00*** | (2006.01) |
| ***A63B 69/00*** | (2006.01) |
| ***A63B 22/00*** | (2006.01) |
| ***A63B 22/20*** | (2006.01) |

(52) U.S. Cl.
CPC .... *A63B 21/00181* (2013.01); *A63B 21/4034* (2015.10); *A63B 22/0058* (2013.01); *A63B 22/203* (2013.01); *A63B 69/0028* (2013.01); *A61H 2201/123* (2013.01); *A61H 2201/1207* (2013.01); *A61H 2201/1215* (2013.01); *A61H 2201/1238* (2013.01); *A61H 2201/1481* (2013.01); *A61H 2201/1642* (2013.01); *A61H 2201/1652* (2013.01); *A61H 2201/1664* (2013.01); *A61H 2201/1676* (2013.01); *A61H 2203/0406* (2013.01); *A63B 2213/00* (2013.01)

(58) Field of Classification Search
CPC ..... A61H 1/0262; A61H 2203/0406; A61H 2201/1676; A61H 2201/1664; A61H 2201/1652; A61H 2201/1481; A61H 1/0255; A61H 1/0259; A61H 1/0266; A61H 2201/12–2201/1246; A61H 2201/164; A61H 2201/1642
See application file for complete search history.

(56) References Cited

U.S. PATENT DOCUMENTS

| | | | |
|---|---|---|---|
| 3,824,994 | A | 7/1974 | Soderberg, Sr. |
| 3,917,261 | A | 11/1975 | Small et al. |
| 5,239,987 | A | 8/1993 | Kaiser et al. |
| 5,421,798 | A | 6/1995 | Bond et al. |
| 7,179,236 | B2 | 2/2007 | Galvez Campos |
| 2010/0268129 | A1 | 10/2010 | Park |
| 2011/0256983 | A1 | 10/2011 | Malack et al. |
| 2012/0101414 | A1 | 4/2012 | Hesse et al. |
| 2014/0243717 | A1 | 8/2014 | Weydert |
| 2015/0141200 | A1 | 5/2015 | Murray et al. |
| 2015/0366737 | A1 | 12/2015 | Wang |

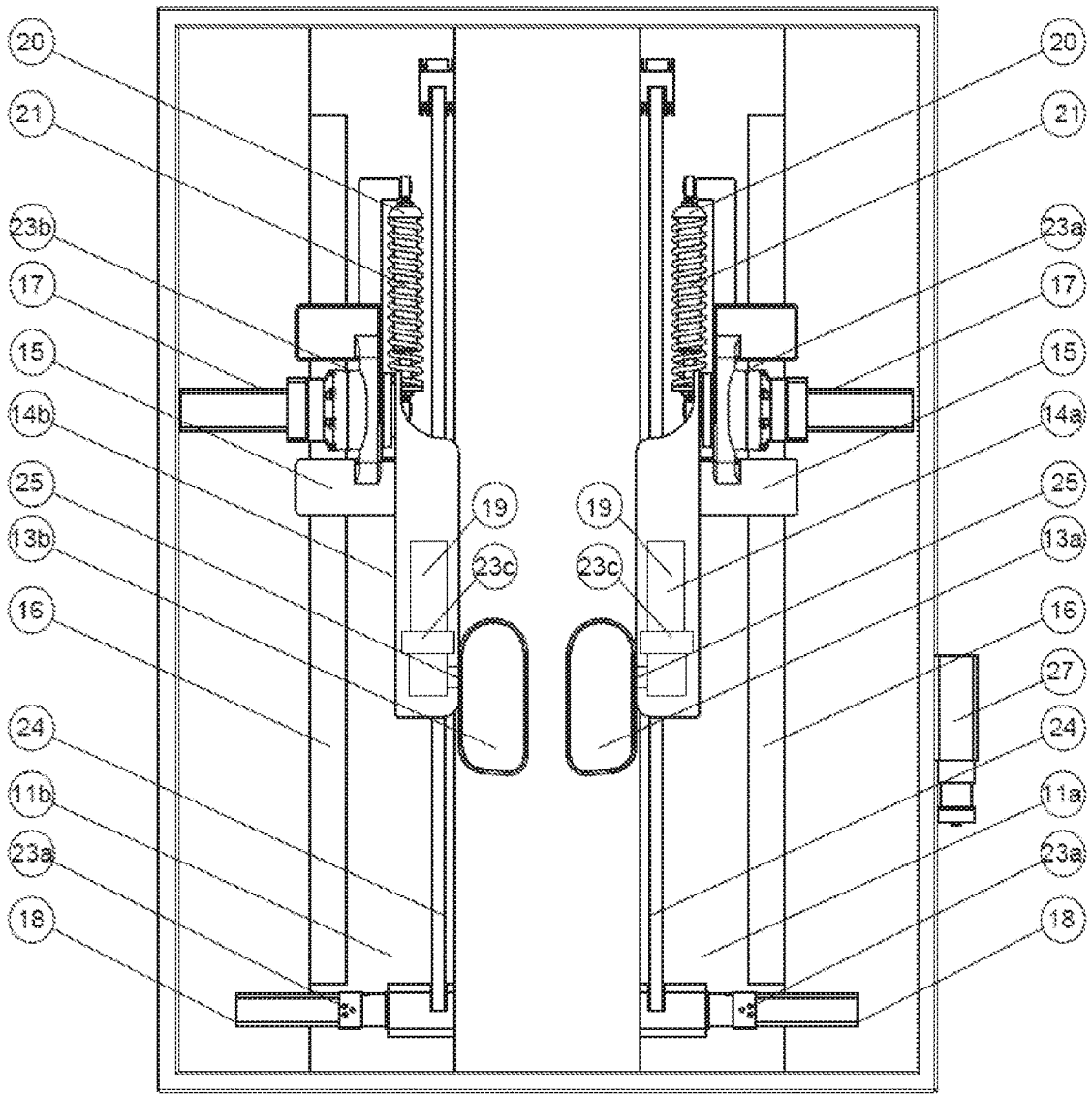
Fig. 4
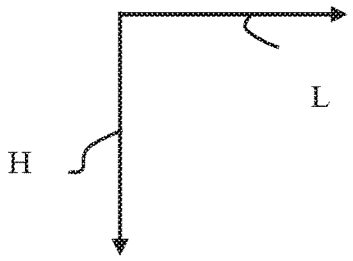

DEVICE FOR CONTROLLING THE TRAINING AND THE THERAPEUTIC TREATMENT AND/OR FOR SUPPORTING THE LOWER EXTREMITIES OF A HUMAN

The invention relates to a device for therapeutic treatment or for training the lower extremities of a human.

Devices for therapeutic treatment or for training the lower extremities of a human are known for instance from DE 10 2006 035 715 A1, DE 20 2008 001 590 U1 and DE 10 2009 022 560 A1.

The therapy of a high grade weakness of the lower extremities for instance after a stroke is difficult and oftentimes not successful. The conventional physical therapy is laborious and targets mostly the releasing of tension and cramps of muscles due to spasms, and to practice, in sitting or standing position, exercises for preparing to walk, in order to, for instance, support the transfer of weight onto the affected leg. This approach oftentimes results in that the patient does not repeatedly practices walking and the foot and leg movements underlying walking.

Modern scientific concepts for rehabilitation favor a repetitive, if possible active practice of walking as soon as possible, or, if not yet possible, practicing at least individual movement patterns of walking with the feet and legs. For stroke patients it could be shown that a repeated active isometric and isotonal dorsal extension of the feet and legs is superior in comparison to a conventional therapy with regard to the back formation of the motoric function of the entire lower extremities. Even larger successes have been achieved when the patient himself or herself repetitively practiced walking. Passive movements of paralyzed extremity sections on the one hand preserve the movability of the movement segment as well as the brain's memory of the movement pattern.

A bilateral practice of the healthy side and the weakened side of the lower extremities is superior to a one sided practice of the weakened side. The co-motion of the non-weakened side thereby applies an enhancing influence on the activation of the brain structures in the parietal lobe responsible for the use of the paralyzed extremity.

For the therapy of the healthy and the weakened side of the lower extremities, mechanical and electromechanical devices are known in the prior art. Concerning this, DE 36 18 686 A1, DE 85 28 083 U1, DE 81 09 699 U1 and DE 195 29 764 A1 are referred to as examples. These known therapy devices comprise foot pedals manipulated by the patient. These foot pedals only allow for an asynchronous retracing by the weakened side. Asynchronous retracing movements do not mirror the diversity of real movement patterns. The transfer of the learning effect in correspondence to the movement pattern from the brain lobe of the healthy side to the affected side which is strived for is thereby only possible with some reservations. Variations of the movement sequences are precluded by the rigid mechanical connection of the constructive elements.

Furthermore, robot systems are known for therapeutic proposes, which include control systems that measure the forces of a patient during the exercise. Thereby, different evaluations of the parameters for the determination of minimal patient movements or forces, and complete comparisons with predetermined programs are possible. Such robot systems are known from DE 100 28 511 A1 as well as the above-mentioned DE 10 2006 035 715 A1, DE 20 2008 001 590 U1 and DE 10 2009 022 560 A1.

Further robots systems employed for therapeutic treatment and/or support of the lower extremities of a human during walking are known from EP 1 137 378 A1 and EP 1 322 272 B1.

In the robot system according to DE 100 28 511 A1, the degree of liberty for lateral movement of the foot plate itself is not required and has furthermore proven to be disadvantageous during exercises. The lateral pivoting of the foot plates requires a complicated and extensive construction which renders the access of the therapists to the patient more complicated. The robot enhanced walking simulator known from DE 10 2006 035 715 A1 has been shown to be worthy of improvements with respect to suitably for daily use. Furthermore, in the systems according to DE 100 28 511 A1 and DE 10 2006 035 715 A1 the access to the patient is rendered complicated.

DE 20 2008 001 590 U1 discloses a training device for human gaits or paces having a kinematic comprising five joints, which is mounted on a linearly driven cart. The drive of the kinematic is provided by a ball screw driving along on top of the car.

DE 10 2009 022 560 A1 describes a robot system having a pivot arm and two sleds, wherein the height movement of the pivot arm is performed via a conrod through the relative movement of both sleds via a ball screw.

In the systems according to EP 1 137 378 A1 and EP 1 322 272 B1, the movement takes place via an exoskeleton which guides the lower extremities in sync with a treadmill via drives in the area of the hip- and knee-joints. These robot systems are limited to walking movement in the horizontal plane.

The problem underlying the invention is the provision of a device for therapeutic treatment and/or for training the lower extremities of a human with which a diversity of load situations can be simulated which occur in everyday life. The device shall allow for an easy access of therapist to the patient.

According to the invention, this problem is solved by the device according to claim 1.

The invention relates to a device for training and therapeutic treatment and/or for supporting the lower extremities of a human. The device according to the invention includes driven, controllable movement devices which are connected to a stationary frame and which comprise holding members for fastening one respective extremity, which holding members are movable independently of one another along a respective predetermined movement pattern. Each of the movement devices comprises a pivot arm which can be oriented in different elevations, the pivot arm being rotatably connected one the one hand to a sled movable along a linear track and on the other hand to a holding member. The training device includes a linear drive for changing the lengthwise position of the respective holding member, a first rotational drive for changing the elevation of the respective holding member, and a second rotational drive for changing the inclination of the respective holding member. The movement sled together with the first rotational drive is movable relative to the stationary frame by the linear drive. The first rotational drive thereby, i.e. when the sled is driven relative to the stationary frame, acts as a carrier for the pivot arm, which transfers the driving force of the linear drive to the pivot arm. Furthermore, the first rotational drive acts as a drive for the elevational movement of the pivot arm.

The invention can be described with respect to a coordinate system having a vertical direction or up-and-down direction, a first horizontal direction which can be described as a forward direction, walking direction or lengthwise direction, and another horizontal direction perpendicular to the first horizontal direction which can be described as the lateral direction. With respect to the patient standing on the movement devices and possibly being connected to the holding members, a so called sagittal plane defined by the vertical direction and the lengthwise horizontal direction. A so called coronal plane is likewise defined by the vertical direction and the lateral horizontal direction. A horizontal plane or transverse plane is thus defined by the horizontal lengthwise direction and the horizontal lateral direction.

The movement sleds each may be designed to be movable exclusively in the lengthwise horizontal or walking direction. As described above, a first rotary drive is movable together with the respective sled. In other words, the first rotational drive can be stationary with respect to the respective sled. The first rotational drive is adapted to move the pivot arm of the respective movement device in a controlled manner for a pivoting movement around a pivot axis which is essentially aligned in parallel to the horizontal lateral direction. In an embodiment of the invention, the first rotational drive is designed to allow exclusively for a restricted pivoting movement which allows for pivoting movement from a position 45°, particularly 30°, more particularly 10°, most particularly 0° below the horizontal plane to a position about 10°, particularly 30°, more particularly 45° above the horizontal plane with respect to the axis of rotation of the pivot arm around which the first rotational drive moves the pivot arm.

On the far end of the pivot arm with respect to the first rotational drive, a second rotational drive and/or a holding member of the respective movement device can be attached. The respective holding member of the movement device can be inclined with respect to the horizontal plane by the second rotational drive. The second rotational drive thus allows for an inclination of the respective holding member which is independent of the inclination of the pivot arm due to the first rotational drive. The second rotational drive may in a preferred embodiment of the invention allow for an orientation of the holding member with respect to a horizontal plane in a range from 90° below the horizontal plane to 90° above the horizontal plane, particularly from 60° or 30° below to 30° or 60° above the horizontal plane; preferably independent of the orientation of the pivot arm.

In a preferred embodiment of the invention, each controllable movement device consists of one movable sled, one pivot arm and one holding member, one first rotational drive, and one second rotational drive. Such a movement device provides a very simple design with the least amount of parts necessary to provide for therapeutic treatment of the lower extremities of a patient. The sled may allow for forward and backward movement of the extremity of the patient with respect to the stationary frame of the training device. The pivot arm may allow for bending and stretching movement of the leg. The holding member, due to being rotatable with respect to the pivot arm, allows for stretching and bending the foot with respect to the lower leg of the patient. Thus, the training device according to the invention allows for an easy access of both, patient and the therapist.

The invention offers the advantage that the mechanics of the movement device is designed simple and compact. The low height of the mechanics simplifies the access of the therapists to the patient.

With the device according to the invention, a successful therapy can on the one hand be achieved through the frequent repetition of individual exercises and on the other hand by transferring learning effects from the brain side responsible for the healthy extremities to the brain side responsible for the weakened extremity or the responsible brain area. Thus, a singular movement pattern within the complete walking cycle can practiced by the patient isolated and repetitively. Also, the device according to the invention allows strengthening of the leg- and back-muscles for further improvement of the well-being of a patient advanced in recovery, as well as a f also or training healthy people. The device according to the invention through a display provides the prerequisite for conducting the walking training or the walking therapy, respectively, either in a predetermined every day-surrounding or for an evaluation of the therapy performance in real-time, wherein, via the robust and simple designed mechanics, different everyday simulations, for instance mounting stairs, accessing a sidewalk, or situations in which the patient stumbles, can be simulated.

Preferred embodiments of the invention are specified in dependent claims.

The linear drive can comprise a force transmission element which couples the first sled to the stationary frame. The linear drive can comprise a driven chain or belt fastened on the one hand to the sled and on the other hand to the frame, such that a horizontal movement of the sled is achieved and simple manner.

In a preferred embodiment, the sled travels along two or more guiding tracks. This allows the sled to be dimensioned broader which leads to an increase of stability of the mechanics, since the load from the patient can be distributed better on the movement mechanics.

In an embodiment of the invention, the guiding tracks extend in parallel to the lengthwise horizontal direction and preferably also in the horizontal plane so that the movement sleds are movable parallel to a horizontal lengthwise or walking direction.

In a preferred embodiment, the stationary frame comprises height-adjustable pedestals in the area of the guiding tracks of the sleds. This allows compensating for possible unevenness of the floor so that the invention also can be employed on uneven floor.

The first rotary drive can comprise a force transmission element which couples the pivot arm to the sled. The height adjustment of the pivot arm can be changed by operation of the force transmission element. The coupling of the pivot arm to the sled via a force transmission element offers the advantage of providing the height-adjustment of the pivot arm directly via the first rotational drive.

In one embodiment of the invention, the elevation or orientation of the pivot arm with respect to the horizontal plane is exclusively determined by the first rotational drive.

In a preferred embodiment, the height-movement of the pivot arm is supported via a system, in particular a force storage device, which can store energy and feed it back to the mechanics when required. Thereby, the drives and force transmission element, specifically the first rotational drive, can be provided with a decreased requirement for space and energy supply, such that the mechanics can be realized more compact and such that the operation is guaranteed in any surrounding.

A force storage device is for example a spring element, in particular a tension-spring or compression-spring, which acts on a lever arm via a guiding, which lever arm is rigidly connected to the pivot arm. This allows for the mechanics to be designed such that the height movement of the pivot arm is supported in its mechanically least favorable position by the energy of the pretension of the spring element.

The first rotational drive for the height adjustment may be arranged distanced from the pivot arm and may be coupled to the pivot arm by means of the force transmission member.

Thereby, the first rotational drive can be arranged in a position more favorable for the movement or for the center of gravity. The force transmission from of the first rotational drive can be exerted from a position distanced from the pivot arm onto the pivot arm, for example via a gear-belt-system on the sled. The first drive pulley can thereby be attached to the first rotational drive. The second drive pulley can be attached to the pivot arm. The force transmission thus proceeds at via the belt from the gear of the first rotational drive to the gear of the pivot arm and thus to the pivot arm itself.

The second rotational drive can comprise a force transmission element which couples the holding member to the pivot arm. The rotation of the holding member is modifiable through operation of the force transmission element. The coupling of the holding member to the pivot arm via a force transmission member is advantageous in that the rotation of the holding member occurs directly via the rotational drive.

The second rotational drive for changing the inclination can be arranged distanced from the holding member and coupled to the holding member by means of a force transmission member. Thereby, the second rotational drive can be arranged in a position more suitable with respect to the center of gravity. Also, the force transmission from the second rotational drive can for example be provided via a gear-belt-system distanced from the holding member to the holding member itself. The first drive pulley can be attached to the second rotational drive. The second driving pulley can be attached to the holding member. The force transmission then proceeds via the belt from the gear of the second rotational drive to the gear of the holding member and thus to the holding member itself.

In a preferred embodiment, the holding member can be attached movably along the force transmission member and can be set via a closing mechanism. The setting of the holding member allows the holding member to be set precisely to the step width.

The above-mentioned arrangements of the respective drives allow, each one by itself and when combined with one another, for a simple set up of the respective movement device which has only a small space requirement.

In a preferred embodiment of the invention, an adjusting device is arranged above the movement device, which adjusting device is adapted for changing the center of gravity of the body of a human. This embodiment has the advantage that by means of the adjusting device, a control over the center of gravity of a patient is possible. With this, on the one hand the human locomotion can be simulated, i.e. the shifting of the center of gravity during a movement along the direction of the movement, which takes place in vertical and lateral direction. On the other hand, by controlling the center of gravity, the correct the performance of the therapeutic movement is enabled so that posture defects, which are caused by compensating movements of the patient, can be prevented. A further advantage of the control over the center of gravity of the body consists in that the balance can be held also in critical situations, such as (simulated) stumbling, slipping or under conditions in which the proprio-receptive component is disturbed. A repeated practice of such situations is required to minimize the patient's risk to fall and to drop. The three-dimensional control of the center of gravity enabled through this embodiment, and the option to influence the proprio-receptive component of the patients by perturbations, provides the conditions required for a safe, repeatable and purposeful training. The perturbations of the proprio-receptive component are performed through the holding members, particularly the foot-plates which are connected to the patients' feet. These can be driven in to any arbitrary position along the three degrees of freedom. Additionally, vibrations can be realized via the holding members.

Figure 2:
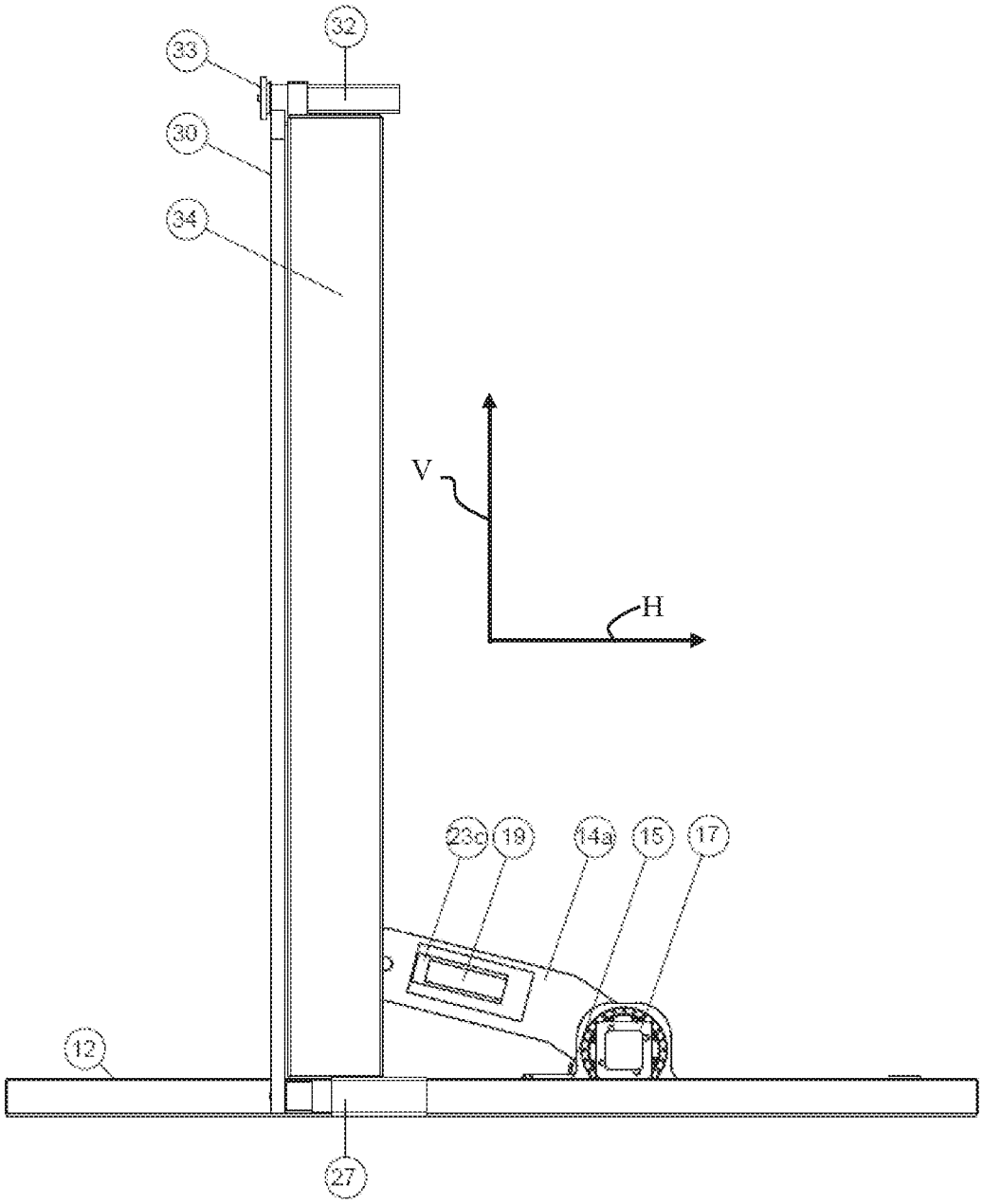
Figure 3:
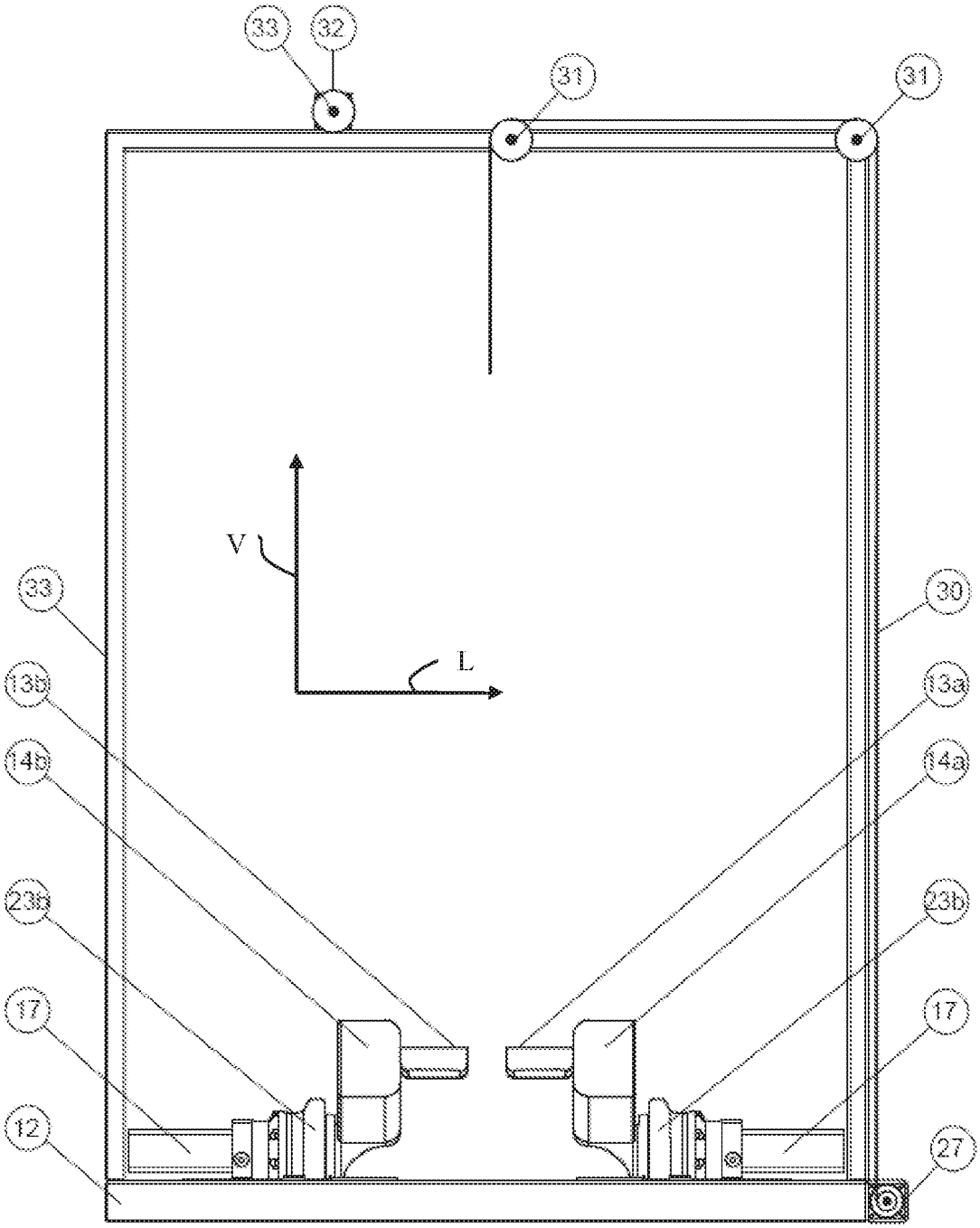

The invention is explained below in further detail with reference to the attached schematic drawings by means of embodiments. In these is shown:

FIG. 1 a perspective view of the device of an embodiment according to the invention;

FIG. 2 side view of the device according to FIG. 1;

FIG. 3 a front view of the device according to FIG. 1; and

FIG. 4 a top view onto the device according to FIG. 1; and

Figure 5:
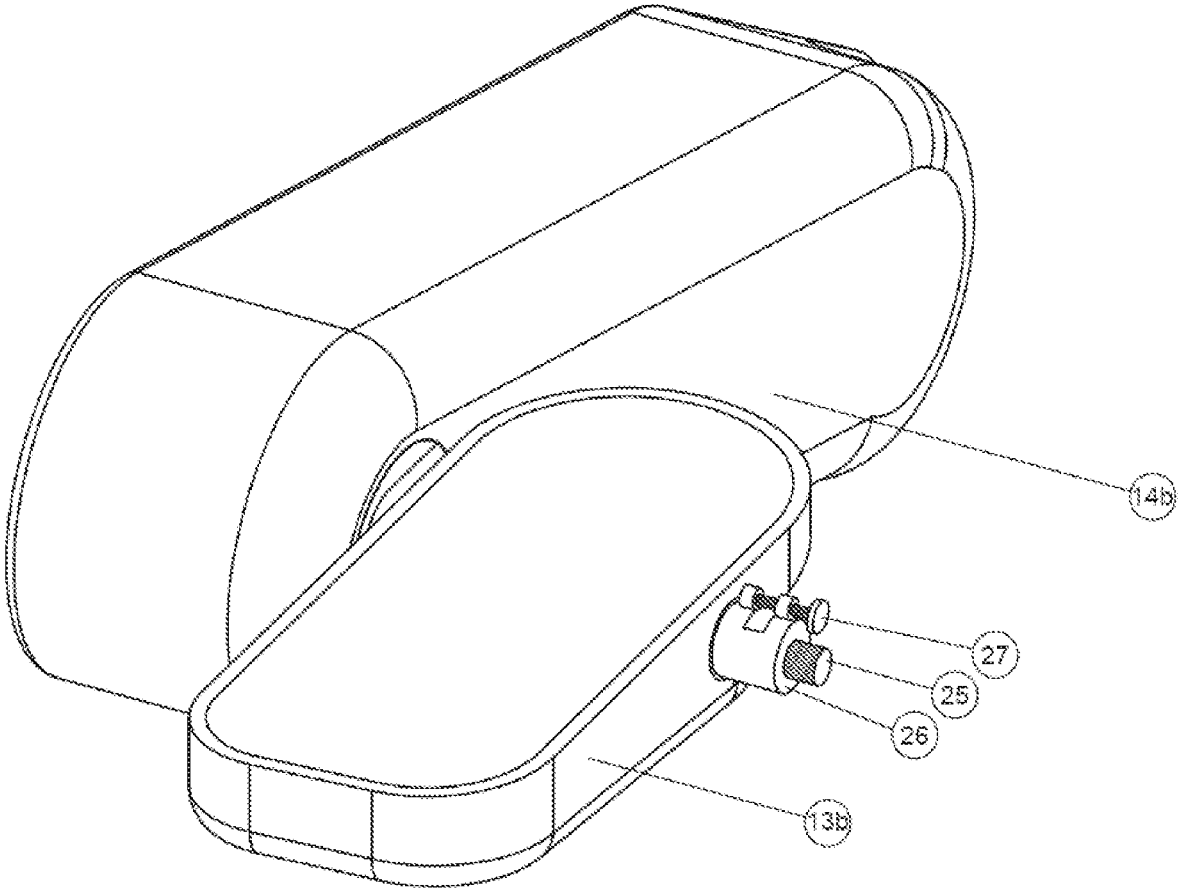

FIG. 5 a perspective view of the closing device for positioning the holding members.

In FIG. 1, a device is shown which can be used for therapeutic treatment and/or for training the lower extremities of a human during any and movement pattern of the human movement in everyday situations or under specific training conditions. This device is particularly suitable for training the lower extremities of neurological patients and comprises two driven, controllable movement units 11*a*, 11*b*. These two movements units 11*a*, 11*b* are each connected to a stationary frame 12. The movement units 11*a*, 11*b* comprise holding members 13*a*, 13*b*, for instance foot-plates with binding in which the patient's feet are held. The movement devices 11*a*, 11*b* and thus the holding members 13*a*, 13*b* can be moved independently of one another along calculated movement patterns. This renders asynchronous or synchronous movements possible.

The invention can be described with respect to coordinate system which includes a first horizontal direction or horizontal lengthwise direction H which can also be described as a walking direction or antero-posterior-direction. Perpendicular to the first horizontal direction H but still in the horizontal plane defined preferably by the stationary frame 12 lies in a second horizontal direction L or lateral horizontal direction which can also be described as a medio-lateral direction. A vertical direction V extends perpendicular to the plane defined by the horizontal directions H, L; that is perpendicular to the stationary frame 12 or the floor on which it sits. A sagittal plane would in this case be defined with respect to the patient by the first horizontal (walking) direction H and the vertical direction V and a coronal plane would be defined by the lateral horizontal direction L and the vertical direction V. The leg movement of the patient occurs mainly in the sagittal plane. To this end, the leg movement of the patient attached with the lower extremities to one of a holding member 13*a*, 13*b* occurs essentially in the sagittal plane, or in other words in vertical direction V and the first horizontal direction H.

The device comprises a rack 34 via which the patient is connected to the adjusting device for changing the center of gravity of the body and which is rigidly connected to the stationary frame 12. The rack 34 comprises two arms 35*a*, 35*b* extending in vertical direction from the floor upwards, wherein the arms 35*a*, 35*b* are rigidly coupled to the stationary frame 12 approximately the height of the movement devices 11*a*, 11*b*. At the top end of the arms 35*a*, 35*b*, a horizontally arranged connection element 36 is provided which connects the arms 35*a*, 35*b*. Two side rails 37*a*, 37*b* can be arranged and can be vertically adjustable on the arms 35*a*, 35*b* approximately in the height of the lower arms of the respective patient. The side rails 37*a*, 37*b* serve as handles for patients, which can hold onto the side rails 37*a*, 37*b*.

The movement devices 11*a*, 11*b* each comprise a pivot arm 14 which is pivotable to different elevations. Therefore, the pivot arm is pivotably attached to one single sled 15 which is guided by a linear track 16. The linear track 16 is firmly connected to the stationary frame 12 and forms a rail in which the sled 15 is moveably arranged. As can be seen in FIGS. 1, 2 and 4, the pivot arm 14 is at its end connected to the sled 15 by means of the first rotational drive 17 in a movable manner.

The pivot arm 14 preferably consists of one single piece with extends from the axis of rotation around which the pivot arm is movable with respect to the sled by means of the first rotational drive 17 to the second axis of rotation around which the holding member 13 is rotatable with respect to the pivot arm 14 by means of a second rotational drive 19. It shall be clear that the pivot arm 14 can comprise several structurally integrally coupled pieces.

The pivot arms 14 are each connected rotationally movable to one of the holding members 13*a*, 13*b*. The connection junction between the holding member 13*a*, 13*b* and the pivot arm 14 is arranged at the other, second lengthwise end of the pivot arm 14.

The connection junction is preferably determined by the force transmission element; in that the first connection junction between the sled 15 and the pivot arm 14 is determined by the first transmission member whereas the second connection junction is determined by the force transmission member coupling the pivot arm 14 to the holding member 13.

The pivot arms 14*a*, 14*b* extend in lengthwise direction of the respective linear track 16. The pivot arms 14*a*, 14*b* are each movable on a circular path which runs along the lengthwise direction of the respective linear track 16. The pivot arms 14*a*, 14*b* are each rotatably connected to the sled 15 via the first rotational drive 17. The position of the center of rotation of the respective pivot arm can thereby be arranged in any desired position.

The pivot arms 14*a*, 14*b* can each be supported by a force storage system 20 that is attached on one end thereof to the sled 15 and on the other end thereof to the pivot arm and which is able to store power and to return the power to the movement mechanics. Such a system comprises for instance a tension spring or compression spring 21 guided along a guiding element 22 which is movably attached on the pivot arm 14 and the sled 15 and which acts upon the pivot arm 14 of the sled 15. Other embodiments are possible.

In the device shown in the figures, the force storage device 20 is realized by a compression spring 21 pretensioned in the least favorable position of the pivot arm. In other words, the pressure spring 21 is pretension or biased when the respective pivot arm 14*a*, 14 *b* is arranged in the lowermost horizontal position. When the pivot arm 14*a*, 14*b* is pivoted upwards by means of the first rotational drive 17, this movement is supported by the compression the spring 21 which is thereby relaxed.

As indicated in the figures, the spring or generally the force storage device 20 is on the one hand attached to the sled 15, specifically to a L-shaped holding arm 22*a* thereof. Thereby, the first shank of the holding arm 22*a* extends in the lengthwise direction of the linear track 16. The shorter second shank of the holding arm 22*a* extends perpendicular thereto and is connected to a first end of the force storage device 20, specifically to the spring 21. The second end of the spring 21 is connected to one end of the pivot arm 14*a*, 14*b*. The connection between the pivot arm 14*a*, 14*b* and the spring 21 is defined such that the spring exerts a torsional moment onto the pivot arm 14*a*, 14*b*. To this end, the spring is rigidly connected to a lever (not shown) on the spring arm 14*a*, 14*b*.

The spring 21 is guided by a guiding rod 22. The guiding rod 22 is arranged within the spring 21. The guiding is on the one hand attached to the holding arm 22*a* and on the other hand to the pivot arm 14*a*, 14*b*. For length adjustment, the guiding rod 22 is telescopic. Other guiding possibilities are imaginable.

Instead of the compression spring 21, a tension spring can be used. This would then have to be attached on the opposite side and to be attached to the sled or the pivot arm, respectively.

Generally, the pivot point of the pivot arm 14 is mounted in an area or a position which is arranged between the connection of the respective pivot arm 14*a*, 14*b* to the sled 15 and the connection of the pivot arm 15 and the holding members 13*a*, 13*b*.

Through the rotational movement of the pivot arm 14, the angle between the pivot arm 14 and the sled 15 is changed. As illustrated in FIGS. 1, 2 and 4 with both pivot arms 14*a*, 14*b*, by increasing the angle of the pivot arm 14 it is moved upwards, wherein the holding member 13*a*, 13*b* describes a circular path around the connection point or junction of the pivot arm 14 and the sled 15, or generally with respect to a horizontal axis across the walking direction. Thereby, the elevation of the second lengthwise end of the pivot arm 14 and thus of the of the holding member 13*a*, 13*b* attached to the second lengthwise end is changed.

Due to the mounting of the pivot arm 14 to the sled 15, the pivot arm 14 is taken along by the movement of the sled 12, such that the horizontal movement of the entire movement device 11*a*, 11*b* is achieved.

As can be seen in FIGS. 1, 2 and 4, the sled 15 comprises a linear drive 18 which is provided for changing the lengthwise position or horizontal position of the respective holding member 13*a*, 13*b*. The first linear drive 18 comprises a first force transmission member 23*a* connecting the sled 15 to the stationary frame 12 for force transmission. The first force transmission member 23*a* can comprise a driven toothed belt 24 connected on the one hand to the movable sled 15 and on the other hand to the stationary frame 12. One respective electric motor is provided for driving the toothed belt 24. The linear drive 18 can also be realized by other means, for example a driven chain, by a tooth rack or by hydraulic or pneumatic cylinders.

The first rotational drive 17 is associated to the sled 15 and couples the sled 15 to the pivot arm 14. Therefore, a second force transmission element 23*b* is provided which engages on the one hand the first sled 15 and on the other hand the pivot arm 14. The second force transmission element has the function to take along the pivot arm 14 in case of the movement of the sled 15. Thereby, the second force transmission element 23*b* acts as a pushing element or pulling element. Additionally, the second force transmission element 23*b* transfers a force from the pivot arm 14 to the sled 15 or vice versa, when the second force transmission element 23*b* is operated. Thereby, the angle between the sled 15 of the pivot arm 14 and thus the elevation of the respective pivot arm 14*a*, 14*b* is changed.

The linear drive 18 provides a main drive which moves the sled 15 together with the first rotational drive 17 relative to the stationary frame 12. The first rotational drive 17, particularly the second force transmission element 23*b* thereby acts as a carrier which transfers the driving force of the linear drive 18 to the pivot arm 14. Additionally, the first rotational drive 17 acts as an elevation drive for the vertical or elevating movement of the pivot arm 14, as described above.

The second force transmission member 23*b*, for example in the form of a gear box, is rotatably connected to the sled 15 and provides for taking along or carrying and height-adjustment of the pivot arm 14.

In the embodiment according to FIG. 1, the first rotational drive 17 is fastened to the sled 15 and coupled to the force transmission member 23*b*. Other force transmission elements, for instance a toothed rack, or hydraulic/pneumatic operating elements are possible. Generally, the force transmission element 23*b* has a dual function and acts both as a carrier as well as for height-adjustment of the pivot arm 14.

The sled 15 is arranged at the movement device 11*a* on the right in the forward direction, wherein the pivot arm 14 extends in the forward direction towards the frame 12. An orientation of the pivot arms 14*a*, 14*b* towards the frame 12 is possible in each direction. Thereby, other orientations of the pivot, possibly extending perpendicular downwards are covered.

For setting the inclination of the holding member 13*a*, 13*b*, a second rotational drive 19 is provided which cooperates with the respective rotatably connected holding member 13*a*, 13*b*. The rotational drive 19 is arranged in the area of the forward end of the pivot arm 14*a*, 14*b*. The connection of the rotational drive 19 to the respective holding member 13*a*, 13*b* is provided by a third force transmission element 23*c*, for example in the form of a gear box. Other force transmission elements, such as a toothed rack or hydraulic/pneumatic operating elements are possible. The force transmission element 23*c* acts both as a carrier as well as a inclination adjustment for the holding element 13.

The rotational drive 19 can also be arranged in the area of the respective rear end of a pivot arm 14*a*, 14*b*. The connection of the rotational drive 19 to the respective holding member 13*a*, 13*b* in this case occurs via the third force transmission element 23*c* via a belt which is on one hand attached on the drive pulley on the pivot arm 14 and on the other hand on a drive pulley connected to the holding member 13*a*, 13*b*. Through the rotational drive 19 the inclination of the holding member 13*a*, 13*b* is adjusted and adapted to the respective position of the pivot arm 14. Thereby, all possible inclinational positions are variably adjustable which are required for the simulation of training situations and everyday situations.

The movement of the holding members 13*a*, 13*b* occurs in a working plane extending in sagittal direction, wherein a working range has been shown to be suitable which allows forward movements in a range of 0 mm to 800 mm, particularly 650 mm, the height movement in the range of 0 mm to 400 mm, particularly about 250 mm, and the inclination movement of the holding member 13*a*, 13*b* in a range of −80° to 30°.

The movements described above can be defined with respect to a zero-position of the patient in which the movement devices are arranged such that the movement sleds 15 are arranged next to each other in the lengthwise horizontal direction L and in which the pivot arms 14*a*, 14*b* and the holding members 13*a*, 13*b* extend in the horizontal lengthwise direction so that an upright standing position of the patient is realized. From this zero-position or initial position, the movement devices can then be moved independently from one another according to the respective movement pattern to simulate or follow walking movement of the patient. Preferably, the movement range of each movement device is restricted to the ranges described above.

The inclination movement of the holding member 13*a*, 13*b* occurs around a horizontally extending axis. This horizontally extending axis is moved horizontally by operating the linear drive 18 and moved vertically by operating the first rotational drive 17.

The holding members 13*a*, 13*b* can be positioned along the horizontally extending axis 25 via a guide 26 and the closure 27 such that the distance between the holding members 13*a*, 13*b* corresponds to the physiological step width of the respective patient. This ascertains that the patient correctly loads weight onto his or her joints in order to maximize the training efficiency since no compensatory movements or adaptions if the patient is required during the performance of the movement pattern predetermined by the device according to the invention. Such a closure device is illustrated in FIG. 5, wherein the horizontally extending axis 25 is determined by a toothed rod on which the guide 26, when through operation of the closure 27 in form of a screw, is firmly canted so that thereby a displacement along the horizontal axis 25 is no longer possible.

For simulating everyday situations of human locomotion, holding members 13*a*, 13*b* for the lower extremities can be simulated through programmed predeterminations of the control as well as by foot plates yielding to the patient, with the patient standing on the holding member and being fastened thereto. Thereby, the control can be varied between a programmed movement and movement led by the patient. Alternatively, one holding member 13*a* can be controlled by the patient and the other holding member 13*b* can be controlled by programmed predeterminations.

In the embodiment according to FIG. 1, an adjusting device 28 is provided which is arranged adjacent to the movement device 11*a*, 1 *b*. The adjusting device 28 is arranged above the linear guiding track 16 so that the movement device 11*a*, 11*b*, in particular the holding members 13*a*, 13*b*, are movable below the adjusting device 31. The adjusting device 28 is adapted for controlling the center of gravity of the body or for adjusting the center of gravity of the body of a human connected to the holding members 13*a*, 13*b*. The adjusting device 28 allows for a change of the center of gravity of the body both in vertical direction, as well as in transversal direction. To this end, the adjusting device 28 includes a vertical drive 29 which cooperates with a belt 30. The belt 30 is connected to a patient carrier belt (not illustrated). The vertical drive allows for a change of the length of the vertical section of the belt 30 so that the center of gravity of the patient can be moved in vertical direction. The working area of this mechanism, or of the adjusting device 31 for changing the center of gravity, amounts to +/−10 cm with respect to a zero-position. Other ranges are possible. One example for an embodiment of an adjusting device 28 is shown FIGS. 1, 2 and 3 and can comprise a further rotational drive for lifting the belt 30 via a roll-system 31 and thus vertically controls the center of gravity of the patient. Lowering the patient or lengthening of the belt 30 is also possible.

Other devices for lifting and lowering the belt 30 are possible.

For controlling the transversal component of the center of gravity, a transversal drive 32 is provided, which comprises another, further rotational drive connected to a disk 33. A rope (not illustrated) is fastened to the disk 33, the end of which rope reaches to the patient. The rope is looped around a roll system (not illustrated) and engages with both of its ends, for example through a carabiner, to lateral eyes on the patient belt. By rotating the disk 33, the patient is pulled in a transversal direction by shortening of one of either rope ends. A possible working space for the movement of the center of gravity by means of the transversal drive 32 for example amounts to +/−15 cm to a zero-position. Other ranges are possible.

The control of the center of gravity in forward- or backward direction is achieved through the relative movement of the holding members 13*a*, 13*b* or the foot plates with respect to the attachment point of the adjusting device 28. The position of the sled 15 can be freely controlled on the linear track 16. Thereby, the attachment point of the patient is stationary in one direction parallel to the linear track 16, such that a corresponding displacement of the center of gravity is possible. The possible working space with respect to the step-length amounts to +/−10 cm with respect to a zero-position. Other ranges are possible.

The device allows for a particularly variable and flexible therapy or training of the lower extremities, wherein the device is simple and compact in its design and therefore allows for an easy access to the patient.

LIST OF REFERENCE NUMERALS

11*a*, 11*b* movement device
12 frame
13*a*,13*b* holding member
14*a*,14*b* pivot arm
15 sled
16 linear track
17 first rotational drive
18 linear drive
19 second rotational drive
20 force storage device
21 spring
22 guide
22*a* lever arm
23*a*, 23,*b*, 23*c* force transmission elements
24 toothed belt
25 axis
26 guide
27 closures
28 adjusting device
29 vertical drive
30 belt
31 roll system
32 transversal drive
33 disk
34 frame
35*a*, 35*b* arms
36 connecting element
37*a*, 37*b* side rail

We claim:

1. A device for training and therapeutic treatment and/or supporting the lower extremities of a human comprising:

a first driven, controllable movement device and a second driven, controllable movement device connected to a stationary frame, the first driven, controllable movement device and the second driven, controllable movement device being movable independently of one another to define first and second predetermined movement patterns;

the first driven, controllable movement device comprising:

a first linear track;

a first movement sled mounted for linear movement on the first linear track;

a first pivot arm pivotably connected to the first movement sled at a first connection junction comprising a first transmission, the first transmission supporting the first pivot arm in a cantilevered manner;

a first foot plate pivotably connected to the first arm, the first foot plate configured for fastening to a first extremity;

a first linear drive for moving the first movement sled along the first linear track for changing the lengthwise position of the first foot plate; and a first rotational drive operatively connected to the first transmission for pivoting the first pivot arm relative to the first movement sled for changing the elevation of the first holding member;

the second driven, controllable movement device comprising:

a second linear track;

a second movement sled mounted for linear movement on the second linear track;

a second pivot arm pivotably connected to the second movement sled at a second connection junction comprising a second transmission, the second transmission supporting the second pivot arm in a cantilevered manner;

a second foot plate pivotably connected to the second arm, the second foot plate configured for fastening to a second extremity;

a second linear drive for moving the second movement sled along the second linear track for changing the lengthwise position of the second foot plate; and a second rotational drive operatively connected to the second transmission for pivoting the second pivot arm relative to the second movement sled for changing the elevation of the second foot plate.

2. The device according to claim 1, wherein the first driven, controllable movement device further comprises a third rotational drive for pivoting the first foot plate relative to the first arm, further wherein the second driven, controllable movement device further comprises a fourth rotational drive for pivoting the second foot plate relative to the second arm.

3. The device according to claim 2, wherein the first pivot arm is connected to a first spring for supporting the first rotational drive and the second pivot arm is connected to a second spring for supporting the second rotational drive.

4. The device according to claim 3, wherein the first spring is attached at one end to the first moving sled and at the other end to the first pivot arm and the second spring is attached at one end to the second moving sled and at the other end to the second pivot arm.

5. The device according to claim 3, wherein the orientation of the first pivot arm is changed by operation of the first rotational drive through the first transmission and the orientation of the second pivot arm is changed by operation of the second rotational drive through the second transmission.

6. The device according to claim 2, wherein the third rotational drive comprises a third transmission which couples the first pivot arm to the first foot plate and the fourth rotational drive comprises a fourth transmission which couples the second pivot arm to the second foot plate.

7. The device according to claim 1, wherein the first linear drive comprises a first transmission which couples the first movement sled to the stationary frame and the second linear drive comprises a second transmission which couples the second movement sled to the stationary frame.

8. A device for training and therapeutic treatment and/or supporting the lower extremities of a human comprising:

a first driven, controllable movement device and a second driven, controllable movement device connected to a stationary frame, the first driven, controllable movement device comprising:

a first linear track;

a first movement sled;

a first pivot arm;

a first holding member;

a first linear drive; and a first rotational drive;

the second driven, controllable movement device comprising:

a second linear track;

a second movement sled;

a second pivot arm;

a second holding member;

a second linear drive; and a second rotational drive;

the first holding member for fastening to a first extremity and the second holding member for fastening to a second extremity, the first holding member and the second holding member being movable independently of one another along a predetermined movement pattern;

the first and second pivot arms are movable to different elevations, the first pivot arm being rotatably connected on a first side thereof to the first movement sled and being movable along the first linear track and the second pivot arm being rotatably connected on a first side thereof to the second movement sled and being moveable along the second linear track and the first pivot arm being rotatably connected on a second side thereof to the first holding member and the second pivot arm being rotatably connected on a second side thereof to the second holding member;

the first linear drive changing the lengthwise position of the first holding member and the second linear drive changing the lengthwise position of the second holding member, the first rotational drive for changing the elevation of the first holding member and the second rotational drive for changing the elevation of the second holding member, the first movement sled together with the first rotational drive being movable relative to the stationary frame by the first linear drive and the second movement sled together with the second rotational drive being movable relative to the stationary frame by the second linear drive;

the first rotational drive acting as a carrier for the first pivot arm, the first rotational drive transferring the driving force of the first linear drive to the first pivot arm and the second rotational drive acting as a carrier for the second pivot arm, the second rotational drive transferring the driving force of the second linear drive to the second pivot arm; and the first rotational drive acts as a drive for changing the elevational orientation of the first pivot arm and the second rotational drive acts as a drive for changing the elevational orientation of the second pivot arm.

9. The device of claim 8, wherein that the first linear track and the second linear track comprise several guiding rails, along which at least one of the movement sleds are movably arranged.

10. The device of claim 8, wherein the first rotational drive comprises a force transmission element attached to at least one of the movement sleds and rotatably connects the at least one of the movement sleds to one of the pivot arms, wherein the orientation of one of the pivot arms is changeable by operation of the force transmission element.

11. The device of claim 8, wherein the first rotational drive comprises a force transmission element which is connected to a respective pivot arm and which rotatably connects the respective pivot arm, wherein the orientation of the respective pivot arm is changeable by operating the force transmission element.

12. The device of claim 8, wherein each of the pivot arms is connected to a force storage device for supporting the first rotational drive.

13. The device of claim 12, wherein the force storage device comprises at least one spring which is attached to at least one of the movement sleds and to the pivot arm.

14. The device of claim 13, wherein at least one of the springs acts along a guiding element which is moveably connected to the pivot arm and to the moving sled.

15. The device of claim 8, wherein the first linear drive and the second linear drive each comprise a force transmission element which couples a corresponding one of the movement sleds to a corresponding stationary frame.

16. The device of claim 8, wherein the first linear drive and the second linear drive each comprise a driven toothed belt which is connected to a corresponding movement sled.

17. The device of claim 8, wherein the second rotational drive is fastened to the respective pivot arm or to the respective holding member and couples the respective holding member to the respective pivot arm.

18. The device of claim 8, wherein the second rotational drive comprises a force transmission element which couples one of the pivot arms to a corresponding one of the holding members.

19. The device of claim 8, wherein the first holding member is arranged moveably along its own axis via a guide and wherein the distance to the first pivot arm is adjustable through a closure.

20. The device of claim 8, wherein an adjustment device is arranged above one of the controllable movement devices, which is adapted to change the center of gravity of a body of a human connected to one of the holding members.

* * * * *